United States Patent [19]

Faure

[11] Patent Number: 5,047,092

[45] Date of Patent: Sep. 10, 1991

[54] ALUMINIUM BASED ALLOY WITH A HIGH YOUNG'S MODULUS AND HIGH MECHANICAL, STRENGTH

[75] Inventor: Jean-Francois Faure, Voiron, France

[73] Assignee: Pechiney Recherche, Courbevoie, France

[21] Appl. No.: 503,903

[22] Filed: Apr. 4, 1990

[30] Foreign Application Priority Data

Apr. 5, 1989 [FR] France ..... 89 04700

[51] Int. Cl.[5] ..... C22C 21/10

[52] U.S. Cl. ..... 148/11.5 A; 148/12.7 A; 420/532; 428/659

[58] Field of Search ..... 148/11.5 A, 12.7 A; 420/532; 428/659

[56] References Cited

U.S. PATENT DOCUMENTS

| | | | |
|---|---|---|---|
| 3,563,814 | 2/1971 | Lyle et al. | 148/12.7 |
| 3,791,876 | 2/1974 | Kroger | 148/2 |
| 4,462,843 | 7/1984 | Baba et al. | 148/11.5 A |
| 4,711,762 | 12/1987 | Vernam et al. | 148/11.5 A |
| 4,747,890 | 5/1988 | Meyer | 420/532 |
| 4,830,826 | 5/1989 | Ichiro | 420/532 |
| 4,874,578 | 10/1989 | Homberger et al. | 148/11.5 A |

FOREIGN PATENT DOCUMENTS

| | | | |
|---|---|---|---|
| 0081441 | 6/1983 | European Pat. Off. . | |
| 0105595 | 4/1984 | European Pat. Off. . | |
| 0213850 | 12/1983 | Japan | 148/11.5 A |

*Primary Examiner*—Roy Upendra

*Attorney, Agent, or Firm*—Dennison, Meserole, Pollack & Scheiner

[57] ABSTRACT

The invention concerns aluminum based alloys of the 7000 series with a high Young'3 s modulus (E≧74 GPa), high mechanical strength ($R_{0.2}$≧530 MPa in the longitudinal direction), good tenacity (KIC, longitudinal direction ≧20 MPa√m ), and good resistance to corrosion under tension (σ≧250 MPa in the short transverse direction, durability ≧30 days ASTM standard G 38-73. The alloy according to the invention is of the following composition by weight: from 5.5 to 8.45% of Zr; from 2 to 3.5% Mg; from 0.5 to 2.5% up to 0.5% Fe; up to 0.5% Si; other elements ≦0.05% each; and up to 0.15% in all with 0.1≦Zr≦0.5% 0.3≦Cr≦0.6%; and 0.3≦Mn≦1.1%. It is preferably worked by the following process steps: a solid body of the composition claimed above is formed by spray deposition; the body is converted to a worked product, at from 300° to 450° C., the optionally converted cold; and the worked product undergoes heat treatment comprising dissolution, quenching and annealing in a T6 or T7 state.

3 Claims, 1 Drawing Sheet

ALUMINIUM BASED ALLOY WITH A HIGH YOUNG'S MODULUS AND HIGH MECHANICAL, STRENGTH

BACKGROUND OF THE INVENTION

1. Field of the Invention

The invention concerns aluminium based alloys of the 7000 series, in the nomenclature of the Aluminium Association (AA), with a high Young's modulus and good mechanical properties of resistance and tenacity; it also concerns a method of obtaining them.

2. Description of the Related Art

Aluminium alloys of the 7000 series, among the most resistant, generally have a Young's modulus E of the order of 70 GPa but not more than 72-73 GPa.

However, the need for light alloys with a higher Young's modulus (F≧74 GPa) and high resistance ($R_{0.2}$≧530 MPa in the longitudinal direction) is felt in order to lighten structures, particularly in the aeronautical and space fields. These properties must be obtained without markedly prejudicing other use properties such as tenacity (KIC, longitudinal direction ≧20 MPa $\sqrt{m}$) or resistance to corrosion under tension (non-rupture threshold after 30 days ≧250 MPa in the short transverse direction and in the test modium in question).

Aluminium based alloys containing Li with a high modulus of elasticity and good mechanical properties are indeed known. However, their working poses complex problems given the reactivity of the Li, and special, expensive working and casting installations are required. The alloys according to the invention can be worked in conventional installations such as are known in the metallurgy of common Al alloys. Moreover the mechanical resistance properties of Al-Li alloys are generally inferior to those of 7000 alloys.

Type 7000 alloys, which are much more charged with alloy elements and obtained by metallurgical treatment of powders, have good mechanical properties and good resistance to corrosion under tension, but a modulus of less than 74 GPa.

SUMMARY OF THE INVENTION

The invention thus concerns alloys of the following composition by weight (%)

| | |
|---|---|
| Zn: | 5.5-8.45 |
| Mg: | 2.0-3.5 |
| Cu: | 0.5-2.5 |
| Zr: | 0.1-0.5 |
| Cr: | 0.3-0.8 |
| Mn: | 0.3-1.1 |
| Fe: | up to 0.5 |
| Si: | up to 0.5 |
| other | each ≦ 0.05 |
| elements | total ≦ 0.15 |
| Remainder Al | |

The following is a preferred composition:

| | |
|---|---|
| Zn: | 7.0-8.4 |
| Mg: | 2.0-2.9 |
| Cu: | 0.8-2.0 |
| Zr: | 0.1-0.4 |
| Cr: | 0.3-0.6 |
| Mn: | 0.3-0.9 |

the remainder being identical with the above compositions.

A method of obtaining the alloys comprises:

1. forming a solid body of a composition within the above limits, by spray deposition.

2. converting the body hot into a worked product at from 300°-450° C. then possibly converting it cold.

3. applying heat treatment by dissolving the alloy, quench hardening and annealing it, in a T6 or preferably T7 state as defined by the AA.

DETAILED DESCRIPTION OF THE INVENTION

Figure 1:
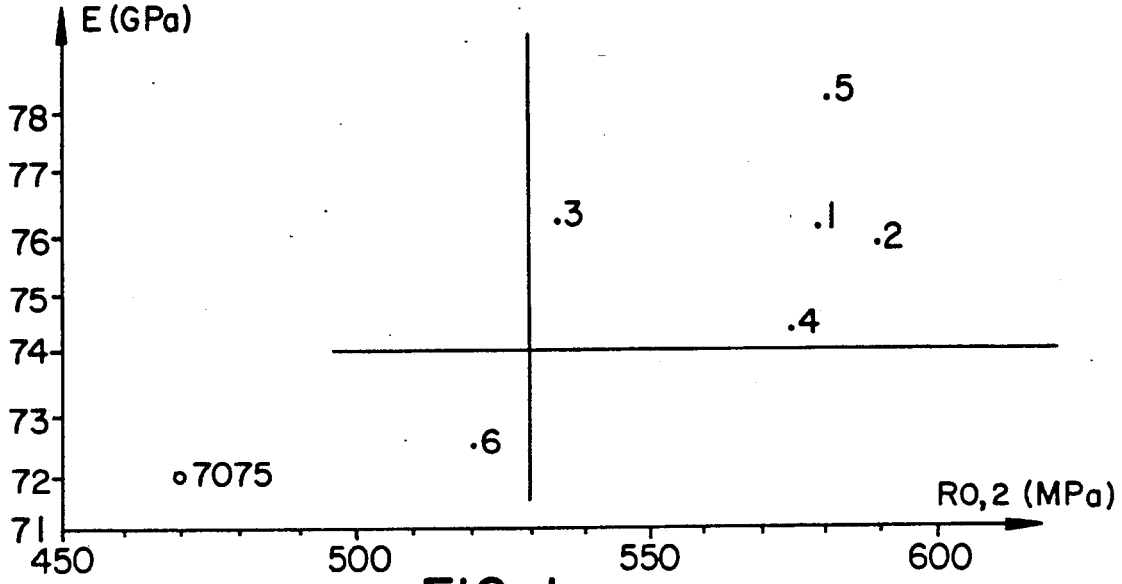
FIGS. 1-3 are graphs of mechanical properties versus $R_{0.2}$ for alloys according to and outside the range of the invention.

Spray deposition is understood as being a process in which the metal is melted and sprayed by a jet of high pressure gas in the form of fine liquid droplets, which are then directed onto and agglomerated on a substrate to form a solid cohesive deposit containing slight closed porosity. The deposit may be in the form of billets, tubes or plates of controlled geometry. A method of this type is known as "spray deposition" in the Anglo Saxon world and is also described as the "OSPREY" process. The latter process is chiefly described in the following patent applications (or patents): GB-B-1379261; GB-B-1472939; GB-B-1548616; GB-B-1599392; GB-A-2172827; EP-A-225080; EP-A-225732; WO-A-87-03012.

The hot conversion stage may be preceded by treatment to homogenise the solid body. This may take place in one or more stages at temperatures from 450° to 520° C. and generally lasting 2 to 50 hours.

The product thus obtained has the required properties mentioned above. These properties are attributed to fine dispersion of type (Al, Mn, Cr) phases and $Al_3$-Zr—due to the combination of the composition of the alloy and the method by which it is obtained. With this structure it is possible to obtain inter alia good ductility, tenacity and a high elastic limit.

Dissolution is generally effected at from 450°-520° C. and the type T6 treatment at from 90° to 150° C., for long enough substantially to obtain peak hardness (2 to 25 hours).

The T7 treatment comprises a type T6 treatment plus annealing at a high temperature, e.g. from 150° to 170° C., for 0.5 to 20 hours.

The invention may also be applied to composite materials hardened by dispersed ceramic particles of the oxide, carbide, nitride, silicide, boride type etc. These are included in the alloy according to the invention, which forms the matrix for them during operation 1, e.g. with powder being injected into the liquid flux.

The particles are from 1 to 50 microns in size and represent a fraction by volume (relative to the metal) of from 3 to 12%.

Figure 2:
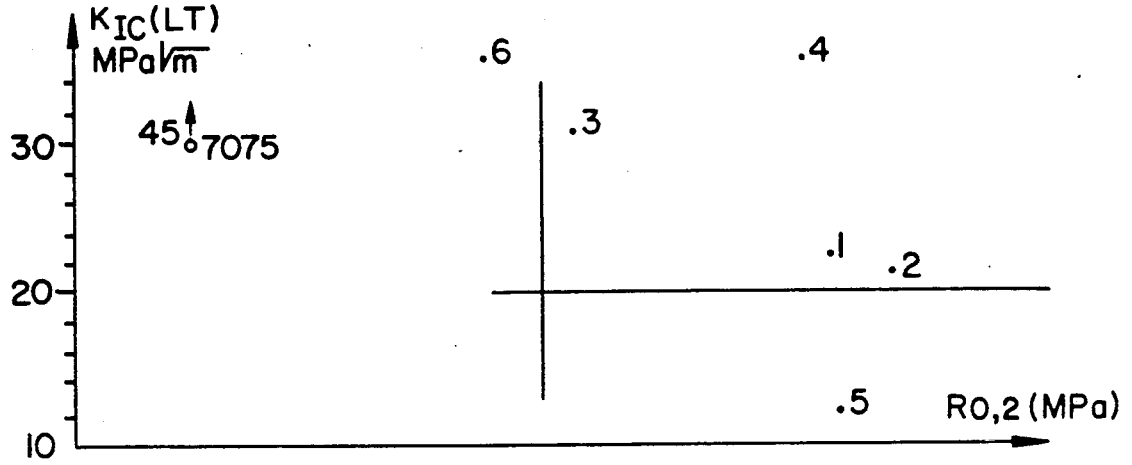
Figure 3:
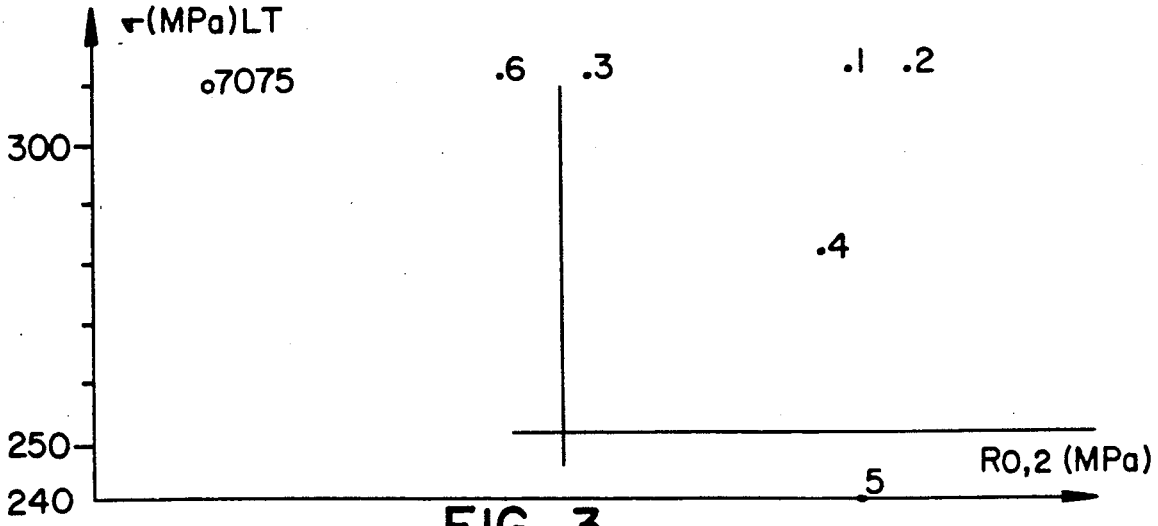

The invention will be understood better from the description of the following tests: alloys numbers 1 to 4 are according to the invention, alloys 5 and 6 beyond the scope of the invention and alloy 7 is a conventional prior art one (7075) which is given for comparison; it has been cast semi-continuously, converted hot and subjected to the same heat treatment as the other alloys. FIG. 1 shows the mechanical properties E and $R_{0.2}$ of the alloys tested, FIG. 2 the tenacity properties as a function of $R_{0.2}$ and FIG. 3 the corrosion under tension properties as a function of $R_{0.2}$.

EXAMPLE

Various alloys, numbered 1 to 6 and of the percentage weight compositions given in Table 1, are melted and worked by spray deposition (OSPREY process) in billet form.

casting temperature: 750° C.

distance from spray to deposit: 600 mm, kept substantially constant during test stainless steel collector with rotating movement spray oscillated relative to axis of rotation of collector gas delivery/metal delivery 2 to 3 $m^3$/kg.

After being scalped to 140 mm diameter, the billets are homogenised for 8 hours at 460° C. The blanks are then hot drawn at 400° C. in a press where the container member has a diameter of 143 mm, in the form of flat parts 50×22 mm in section, giving a drawing ratio of 14.6. The flat parts thus obtained undergo type T7 heat treatment under the following conditions:

dissolving for 2 hours at from 460° to 485° C.

quenching with cold water two stage annealing: 24 hours at 120° C.+ one 20 hour stage from 155° to 170° C.

The mechanical properties obtained are given in Table 2.

Alloys 1 to 4 are within the scope claimed. They have a modulus ≧74 GPa, an elastic limit in the longitudinal direction ≧530 MPa, with good ductility in the longitudinal direction (≧8%) and the long transverse direction (≧6%), tenacity in the L-T direction of at least 20 MPa √m and good resistance to corrosion under tension (measured in accordance with ASTM standard G 38 73).

Alloy 5 is outside the scope of the invention because its Cr and Mn content is too high, and although it has a high modulus and a high elastic limit it is very inflexible and cannot be used for manufacturing parts. Alloy 6 is also outside the scope of the invention, because its Cr and Mn content is too low. It does not have the advantages of the alloys according to the invention; its modulus and elastic limit are low, so it cannot be distinguished from conventional alloys such as 7075.

The composition and properties of a conventional alloy 7075 are given as a comparison. This alloy has been cast in the conventional manner then converted and given the same range of heat treatments as alloys 1 to 6.

The modulus and elastic limit of this alloy will be seen to be well below those for the alloys according to the invention.

TABLE 1

| | Composition alloys tested | | | | | | | | |
|---|---|---|---|---|---|---|---|---|---|
| Alloy | Zn | Mg | Cu | Cr | Mn | Zr | Fe | Si | Remainder |
| 1 | 7.8 | 2.3 | 1.4 | 0.35 | 0.85 | 0.16 | <0.1 | <0.1 | Al |
| 2 | 8.0 | 2.4 | 1.35 | 0.45 | 0.50 | 0.17 | <0.1 | <0.1 | Al |
| 3 | 6.5 | 2.2 | 1.5 | 0.50 | 0.60 | 0.20 | <0.1 | <0.1 | Al |
| 4 | 7.0 | 2.3 | 1.4 | 0.35 | 0.40 | 0.18 | <0.1 | <0.1 | Al |
| 5 | 7.5 | 2.2 | 1.35 | 0.9 | 1.2 | 0.25 | <0.1 | <0.1 | Al |
| 6 | 6.0 | 2.2 | 1.5 | 0.15 | 0.18 | 0.12 | <0.1 | <0.1 | Al |
| 7075 conventional | 5.5 | 2.3 | 1.6 | 0.23 | — | — | <0.05 | <0.04 | Al |

TABLE 2

| | Properties of alloys tested (state T7) | | | | | | | | |
|---|---|---|---|---|---|---|---|---|---|
| | Traction lengthwise | | | Traction in long transverse direction | | | | Tenacity* L-T direction | Corrosion** in tension (nonrupture |
| Alloy | R0.2 (MPa) | Rm (MPa) | A % | R0.2 (MPa) | Rm (MPa) | A % | Modulus (GPa) | (MPA √m) | 30 days) (MPa) |
| 1 | 580 | 620 | 9.0 | 550 | 590 | 7.0 | 76 | 22.5 | 310 |
| 2 | 590 | 630 | 8.5 | 560 | 595 | 6.5 | 75.5 | 21.8 | 310 |
| 3 | 535 | 600 | 12.0 | 520 | 570 | 9.2 | 76.4 | 30.8 | 310 |
| 4 | 575 | 610 | 10.0 | 550 | 580 | 8.5 | 74.5 | 35.2 | 280 |
| 5 | 582 | 612 | 3.0 | 540 | 555 | 1.5 | 78.2 | 12.0 | 240 |
| 6 | 520 | 550 | 13.1 | 500 | 525 | 8.2 | 72.5 | 35.9 | 310 |
| 7075 conventional | 470 | 536 | 14.5 | 428 | 501 | 14.2 | 72.0 | 45.0 | 310 |

*Longitudinal stress, spreading crack in transverse direction

**Tests in short transverse direction in accordance with ASTM G 38 73.

The alloys according to the invention are chiefly designed for the manufacture of sections or pieces of forged or swaged structures.

I claim:

1. A spray deposited, hot worked, aluminum-based alloy, consisting essentially of, by weight:

5.5–8.45% Zn;

2–3.5% Mg;

0.5–2.5% Cu;

0.1–0.5% Zr;

0.3–0.6% Cr;

0.3–1.1% Mn;

up to 0.5% Fe;

up to 0.5% Si;

other elements <0.05% each, up to 0.15% total; and remainder Al, said alloy having the mechanical properties:

E≧74 GPa $R_{0.2}$ (longitudinal dir.) ≧530 MPa

KIC (longitudinal dir.) ≧20 MPa √m

Resistance to corrosion under tension (30 days, short transverse dir.) ≧250 MPa.

2. A spray deposited, hot worked, aluminum-based alloy, consisting essentially of, by weight:

7.0–8.4% Zn;

2–2.9% Mg;

0.8–2.0% Cu;

0.1–0.4% Zr;

0.3–0.6% Cr;

0.3–0.9% Mn;

up to 0.5% Fe;

up to 0.5% Si;

other elements <0.05% each, up to 0.15% total; and remainder Al, said alloy having the mechanical properties:

E≧74 GPa $R_{0.2}$ (longitudinal dir.) ≧530 MPa

KIC (longitudinal dir.) ≧20 MPa $\sqrt{m}$

Resistance to corrosion under tension (30 days, short transverse dir.) ≧250 MPa.

3. An alloy according to claim 1 or 2, containing a homogeneous dispersion of ceramic particles from 1 to 15 microns in size and representing a fraction by volume, (relative to the metal) of from 3 to 12%.

* * * * *